US008634730B2

(12) United States Patent
Hinoue et al.

(10) Patent No.: US 8,634,730 B2
(45) Date of Patent: Jan. 21, 2014

(54) IMAGE FORMING APPARATUS AND IMAGE FORMING METHOD USING THE SAME

(75) Inventors: Kazuma Hinoue, Osaka (JP); Motoyuki Itoyama, Osaka (JP); Hideji Saikoh, Osaka (JP); Takeshi Ohkawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 287 days.

(21) Appl. No.: 13/079,099

(22) Filed: Apr. 4, 2011

(65) Prior Publication Data

US 2011/0262155 A1 Oct. 27, 2011

(30) Foreign Application Priority Data

Apr. 23, 2010 (JP) ..... 2010-099927

(51) Int. Cl.
*G03G 15/08* (2006.01)

(52) U.S. Cl.
USPC ..... 399/30; 399/62

(58) Field of Classification Search
USPC ..... 399/30, 53, 58, 59, 62, 63
See application file for complete search history.

(56) References Cited

U.S. PATENT DOCUMENTS

| | | | |
|---|---|---|---|
| 7,551,862 | B2 | 6/2009 | Tanaka et al. |
| 7,860,415 | B2 | 12/2010 | Tokuyama et al. |
| 2006/0198649 | A1 | 9/2006 | Imamiya |
| 2007/0286617 | A1 | 12/2007 | Tanaka et al. |
| 2008/0124108 | A1 | 5/2008 | Tokuyama et al. |

FOREIGN PATENT DOCUMENTS

| | | | |
|---|---|---|---|
| CN | 101192032 | A | 6/2008 |
| JP | 9-22180 | A | 1/1997 |
| JP | 2002-72661 | A | 3/2002 |
| JP | 2005-331720 | A | 12/2005 |
| JP | 2007-127721 | A | 5/2007 |
| JP | 2007-333876 | A | 12/2007 |

OTHER PUBLICATIONS

Machine translatio of JP 2002-072661, publication date Mar. 12, 2002, printed Apr. 8, 2013.*

* cited by examiner

*Primary Examiner* — Sophia S Chen
(74) *Attorney, Agent, or Firm* — Birch, Stewart, Kolasch & Birch, LLP

(57) ABSTRACT

An image forming apparatus prevents printed images from being degraded in image quality due to failure of the toner concentration to fall within a proper range, by correcting the deviations of the amount of toner consumption and the amount of toner supply depending on the individuality of each image forming apparatus and that enables exact identification of the cause of a fault associated with toner concentration, and providing an image forming method using the apparatus. A toner supply device supplies toner to a developing vessel through an opening in accordance with an instruction from a controller. The presence or absence of toner falling is detected based on the variation of the output from a magnetic permeability sensor when toner is supplied. The controller monitors the output voltage level of the magnetic permeability sensor and adjusts the input gain in accordance with the output voltage level to thereby control toner concentration.

6 Claims, 10 Drawing Sheets

FIG. 9

66 67

| Area | Correction Coefficient |
|---|---|
| 1 | 0.0 |
| 2 | 1.1 |
| 3 | 0.9 |
| 4 | — |
| 5 | — |

IMAGE FORMING APPARATUS AND IMAGE FORMING METHOD USING THE SAME

This Nonprovisional application claims priority under 35 U.S.C. §119(a) on Patent Application No. 2010-99927 filed in Japan on Apr. 23, 2010, the entire contents of which are hereby incorporated by reference.

BACKGROUND OF THE INVENTION (1) Field of the Invention

The present invention relates to an electrophotographic image forming apparatus such as a copier, printer, facsimile machine or the like and an image forming method using this apparatus.

(2) Description of the Related Prior Art

Conventionally, in image forming apparatuses based on electrophotography, the developers used for forming toner images on the photoreceptor drum are roughly classified into two types, namely, the mono-component type developer consisting of a single toner and the dual-component type developer containing a non-magnetic toner and a magnetic carrier.

Since the mono-component developer is suitable to make the system compact but is not suitable for high-speed development, dual-component developing systems are adopted in many cases for high-speed long-life image forming apparatuses. In the developing device using the dual-component developer, the carrier itself are not consumed from the dual-component developer but remains in the developing device without reduction. On the other hand, the toner is consumed and reduced by the operation of development. In this configuration, in order to prevent image quality from becoming unstable due to reduction of the toner that forms the dual-component developer, toner concentration control for supplying toner as appropriate to keep the toner concentration in the dual-component developer falling within a proper range is implemented.

Generally, toner concentration control is, in many cases, performed by using two kinds of control methods in combination. One is the method in which toner is supplied by calculating the amount of toner consumption based on the coverage ratio of input images. The other is the method in which the density of a standard toner image formed on the surface of the electrostatic latent image bearer (photoreceptor drum) is detected and toner supply is performed based on the comparison of the detection result with the predetermined density level.

As part for implementing the above toner concentration control, the image forming apparatus includes a means for detecting toner empty, e.g., a magnetic permeability sensor that detects the presence or absence of toner falling supplied into the developing device. Since the magnetic permeability sensor presents low sensitivity if the output voltage level falls out of the proper range, the detection accuracy of toner falling becomes lowered. For this reason, it is impossible to detect toner falling with precision unless the input gain of the magnetic permeability sensor is periodically adjusted to keep the output voltage level within the proper range.

To deal with this problem, there has been a technical proposal in Patent Document 1 (Japanese Patent Application Laid-open 2002-72661) in which toner concentration control is performed by calculating how the gains of the analog voltage detection values input to the magnetic permeability sensor are deviated from a predetermined value and correcting the output voltage level.

In the above toner concentration control, in the case of toner supply based on the coverage ratio, the calculated toner consumption from the count of pixels in the input image cannot represent the correct amount of the developer actually consumed, and it is also impossible to check whether the correct amount of toner has been supplied based on the calculated consumption of toner. Accordingly, if the amount of toner consumption and/or the amount of toner supply greatly deviate from the calculated value, depending on individuality of each image forming apparatus, this case poses a problem that the toner concentration falls out of the proper range so that the image quality of printed images degrades.

On the other hand, in the above toner control, when toner supply is performed based on the density of the standard toner image it is possible to some degree to compensate for the tendency of the toner concentration to deviate from the proper range, depending on individuality of each image forming apparatus. However, since the input gain of the magnetic permeability sensor is affected by change in toner concentration of the developer, change in fluidity and other physical properties of the developer and changes in temperature and humidity in the operating environment, even if correction is made based on the density of the standard toner image it is impossible to exactly correct the amount of toner consumption and the amount of toner supply, hence posing the problem that deviation of the toner concentration cannot be surely calculated.

Further, when the toner concentration falls out of the proper range, it is impossible to determine that the trouble is either a controllable error that is attributed to the individuality of each image forming apparatus or an uncontrollable error that is attributed to a fault of the image forming apparatus, hence posing the problem that it is impossible to suitably determine the operation of image printing to be permitted or to be prohibited.

SUMMARY OF THE INVENTION

The present invention has been devised in view of the above circumstances, it is therefore an object of the present invention to provide an image forming apparatus that can prevent printed images from being degraded in image quality due to failure of the toner concentration to fall within a proper range, by correcting the deviations of the amount of toner consumption and the amount of toner supply depending on the individuality of each image forming apparatus and that enables exact identification of the cause of a fault associated with toner concentration, as well as providing an image forming method using the apparatus.

In order to achieve the above object, each of the image forming apparatuses of the present invention is configured as follows:

An image forming apparatus of the present invention includes: a toner container storing a toner; a developing unit performing development using a dual-component developer containing the toner and a carrier; a toner supply unit supplying the toner from the toner container to the developing unit; a toner sensor detecting the presence or absence of the toner falling and supplied into the developing unit; and a control unit controlling the operation of image forming, the controller including a toner concentration controller that controls so that the toner concentration of the dual-component developer will fall within a predetermined range, and is characterized in that when detecting that the input gain of the toner sensor falls out of the predetermined range, the toner concentration controller adjusts the input gain of the toner sensor so as to fall within the predetermined range and then control the supplied amount of the toner.

The image forming apparatus of the present invention is characterized in that the predetermined range for the input gain of the toner sensor includes a pair of first thresholds as the criteria for determining whether supply of the toner should be made by performing feedback control in accordance with the input gain of the toner sensor, and a pair of second thresholds as the criteria for determining whether the image forming apparatus is in a breakdown condition so that the image forming operation should be prohibited.

In the image forming apparatus of the present invention, the control unit includes: a calculator calculating the amount of consumption of the toner in accordance with the coverage of the image; and a process control unit performing process control as an image correcting process when images are formed, and is characterized in that the toner concentration controller controls the amount of toner supply, based on the developing bias level when calculation of the amount of toner consumption and the process control are carried out.

In the image forming apparatus of the present invention, the process control unit performs process control by detecting the density of a standard toner image formed on the surface of electrostatic latent image bearer and applying a developing bias in accordance with the detected density.

In the image forming apparatus of the present invention, the toner concentration controller controls the input gain also when the process control is carried out.

In the image forming apparatus of the present invention, the toner sensor uses a magnetic permeability sensor.

An image forming method of the present invention is an image forming method for use in an image forming apparatus comprising: a toner container storing a toner; a developing unit performing development using a dual-component developer containing the toner and a carrier; a toner supply unit supplying the toner from the toner container to the developing unit; a toner sensor detecting the presence or absence of the toner falling and supplied into the developing unit; and a control unit controlling the operation of image forming, and is characterized in that the image forming method includes: a toner concentration control step of performing control such that the toner concentration of the dual-component developer will fall within a predetermined range; and a toner supply control step in which when the input gain of the toner sensor falls out of the predetermined range, the input gain of the toner sensor is adjusted so as to fall within the predetermined range and thereby control the supplied amount of the toner.

The image forming method of the present invention is characterized in that the predetermined range for the input gain of the toner sensor includes a pair of first thresholds as the criteria for determining whether supply of the toner should be made by performing feedback control in accordance with the input gain from the toner sensor, and a pair of second thresholds as the criteria for determining whether the image forming apparatus is in a breakdown condition so that the image forming operation should be prohibited, and, the toner supply control step of controlling the amount of toner supply includes a step of performing control in conformity with the first threshold and the second threshold.

According to the present invention, the image forming apparatus includes: a toner container storing a toner; a developing unit performing development using a dual-component developer containing the toner and a carrier; a toner supply unit supplying the toner from the toner container to the developing unit; a toner sensor detecting the presence or absence of the toner falling and supplied into the developing unit; and a control unit controlling the operation of image forming, the controller includes a toner concentration controller that controls so that the toner concentration of the dual-component developer will fall within a predetermined range. When detecting that the input gain of the toner sensor falls out of the predetermined range, the toner concentration controller adjusts the input gain of the toner sensor so as to fall within the predetermined range and then control the supplied amount of the toner. Accordingly, this configuration enables such control as to make the toner concentration constantly fall within the proper range and proves markedly effective in controlling toner concentration in conformity with change in toner concentration attributed to the individuality of each image forming apparatus.

According to the present invention, the predetermined range for the input gain of the toner sensor includes a pair of first thresholds as the criteria for determining whether supply of the toner should be made by performing feedback control in accordance with the input gain of the toner sensor, and a pair of second thresholds as the criteria for determining whether the image forming apparatus is in a breakdown condition so that the image forming operation should be prohibited. Accordingly, it is possible to control change in toner concentration attributed to the individuality of each machine, change in toner concentration due to variation of the input gain depending on the fluidity and other physical properties of the developer and the temperature, humidity and other factors of the operating environment. Further, the invention provides excellent effect to clearly detect occurrence of malfunction of the image forming apparatus when the toner concentration has reached to an uncontrollable level so that the input gain of the magnetic permeability sensor has shifted to a predetermined range.

According to the present invention, the control unit of the image forming apparatus includes: a calculator calculating the amount of consumption of the toner in accordance with the coverage of the image; and a process control unit performing process control as an image correcting process when images are formed, and, the toner concentration controller controls the amount of toner supply, based on the developing bias level when calculation of the amount of toner consumption and the process control are carried out. Accordingly, this configuration is markedly effective to exactly detect the amount of toner consumption.

According to the present invention, the process control unit of the image forming apparatus performs process control by detecting the density of a standard toner image formed on the surface of electrostatic latent image bearer and applying a developing bias in accordance with the detected density. Therefore, this configuration is markedly effective to exactly detect the amount of toner consumption.

According to the present invention, since the toner concentration controller of the image forming apparatus controls the input gain also when the process control is carried out, this configuration provides excellent effect that the output voltage level of the toner sensor can be periodically adjusted to the optimal output voltage level.

According to the present invention, an image forming method for use in an image forming apparatus comprising: a toner container storing a toner; a developing unit performing development using a dual-component developer containing the toner and a carrier; a toner supply unit supplying the toner from the toner container to the developing unit; a toner sensor detecting the presence or absence of the toner falling and supplied into the developing unit; and a control unit controlling the operation of image forming, and the image forming method includes: a toner concentration control step of performing control such that the toner concentration of the dual-component developer will fall within a predetermined range; and, a toner supply control step in which when the input gain of the toner sensor falls out of the predetermined range, the input gain of the toner sensor is adjusted so as to fall within the predetermined range and thereby control the supplied amount of the toner. Accordingly, this configuration enables such control as to make the toner concentration constantly fall within a proper range and proves markedly effective in control toner concentration in conformity with change in toner concentration attributed to the individuality of each image forming apparatus.

In the image forming method according to the present invention, the two first thresholds and the two second thresholds are flexibly set by producing offset values by adding one or the sum of, the correction value depending on the developer life, the correction value depending on variation in environment and the correction value depending on the coverage ratio. Accordingly, it is possible to perform toner supply control in conformity with variations in developer life, operating environment and coverage ratio. Further, this configuration provides excellent effect to clearly detect occurrence of malfunction of the image forming apparatus when the toner concentration has reached to an uncontrollable level and the input gain of the magnetic permeability sensor has shifted to a predetermined range.

In the image forming method according to the present invention, the predetermined range for the input gain of the toner sensor includes a pair of first thresholds as the criteria for determining whether supply of the toner should be made by performing feedback control in accordance with the input gain from the toner sensor, and a pair of second thresholds as the criteria for determining whether the image forming apparatus is in a breakdown condition so that the image forming operation should be prohibited, and, the toner supply control step of controlling the amount of toner supply includes a step of performing control in conformity with the first threshold and the second threshold. Accordingly, it is possible to control change in toner concentration attributed to the individuality of each machine, change in toner concentration due to variation of the input gain depending on the fluidity and other physical properties of the developer and the temperature, humidity and other factors of the operating environment. Further, the invention provides excellent effect to clearly detect occurrence of malfunction of the image forming apparatus when the toner concentration has reached to an uncontrollable level and the input gain of the magnetic permeability sensor has shifted to a predetermined range.

BRIEF DESCRIPTION OF THE DRAWINGS

FIG. 9 is an example of a table giving a relationship between the input gain of a magnetic permeability sensor and the supply coefficient for each area according to the present embodiment;

DESCRIPTION OF THE INVENTION

Figure 1:
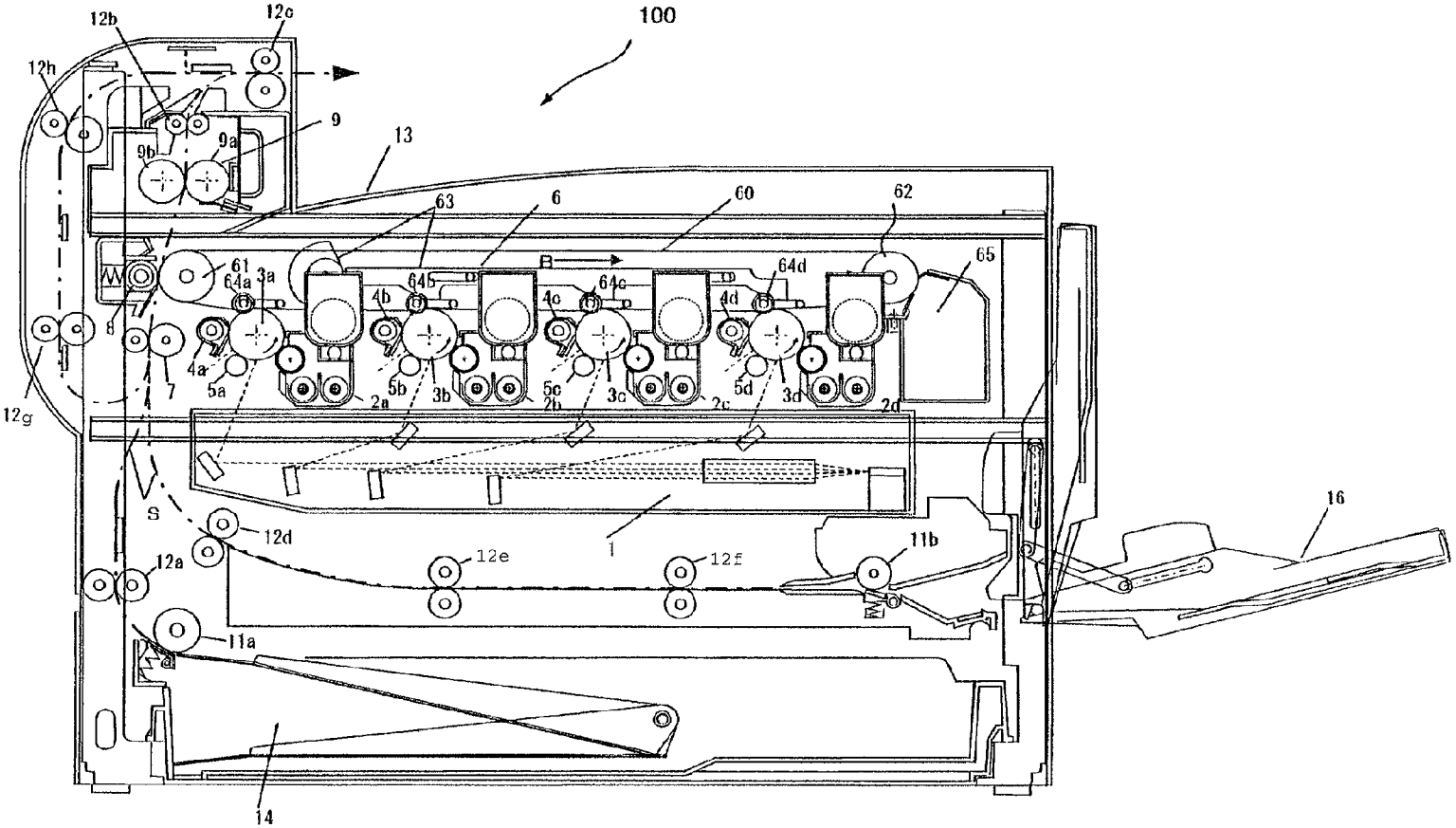
FIG. 1 is a schematic diagram showing a configuration of an image forming apparatus according to an embodiment of the present invention.

Next, an image forming apparatus 100 of the present invention will be described. FIG. 1 is a schematic diagram showing a configuration of image forming apparatus 100 according to the present embodiment.

As shown in FIG. 1, image forming apparatus 100 forms multi-color or mono-color images on recording mediums (paper) in accordance with image data transmitted from the outside via a communication network or image data input from an external storage device (not shown).

Image forming apparatus 100 includes an exposure unit 1, developing devices 2 (2*a*, 2*b*, 2*c* and 2*d*), photoreceptor drums 3 (3*a*, 3*b*, 3*c* and 3*d*), cleaner units 4 (4*a*, 4*b*, 4*c* and 4*d*), chargers 5 (5*a*, 5*b*, 5*c* and 5*d*), an intermediate transfer belt unit 6, a registration roller 7, a transfer roller 8, a fixing unit 9, paper feed trays 14 and 16, a control unit 10, a paper conveyance path S and a paper output tray 13.

In image forming apparatus 100, image data is composed of data for individual colors, i.e., black (K), cyan (C), magenta (M) and yellow (Y) supporting color images. Accordingly, four developing devices 2 (2*a*, 2*b*, 2*c* and 2*d*), four photoreceptor drums 3 (3*a*, 3*b*, 3*c* and 3*d*), four cleaner units 4 (4*a*, 4*b*, 4*c* and 4*d*) and four chargers 5 (5*a*, 5*b*, 5*c* and 5*d*) are provided to form four kinds of electrostatic latent images for different colors. Here, each component is assigned with 'a' for black, 'b' for cyan, 'c' for magenta or 'd' for yellow, thus forming four image stations. Though in this embodiment, color image forming is performed with four colors, the invention can also be applied to multi-color image forming using six colors and to monochrome image forming.

Exposure unit 1 is a laser scanning unit (LSU) using a laser diode as a laser light source. Exposure unit 1 illuminates the peripheral surface of each photoreceptor drum 3 that has been uniformly electrified by charger 5, with light in accordance with input image data so as to form an electrostatic latent image corresponding to the image data on the peripheral surface of photoreceptor drum 3. Here, arrays of light emitting elements such as EL (Electro Luminescence) and LED (Light Emitting Diode) writing heads, may be also used instead of the laser diode.

Developing devices 2 visualize the electrostatic latent images formed on photoreceptor drums 3 with black (K), cyan (C), magenta (M) and yellow (Y) toners, respectively. Details of developing device 2 will be described later.

Cleaner unit 4 includes a cleaning blade (not shown). This cleaning blade is arranged along, and in abutment (or sliding contact) with, the outer peripheral side of photoreceptor drum 3, to remove and collect the toner remaining on the photoreceptor drum 3 surface after development and transfer of the toner image.

Each photoreceptor drum 3 is arranged so that part of the outer peripheral side comes into contact with the surface of intermediate transfer belt 60 while charger 5 as an electric field generator, developing device 2 and cleaning unit 4 are arranged along, and close to, the peripheral side of the drum.

Charger 5 is a charging unit for uniformly electrifying the outer peripheral side of photoreceptor drum 3 at a predetermined potential. Though, in the present embodiment, a discharging type charger is used as charger 5, a roller-type charger, brush-type charger or the like may be used instead of the discharging type charger.

Intermediate transfer belt unit 6 is arranged over photoreceptor drums 3, and includes intermediate transfer belt 60, an intermediate transfer belt drive roller 61, an intermediate transfer belt driven roller 62 and an intermediate transfer belt cleaning unit 65. Further, intermediate transfer belt 60 is supported and tensioned by intermediate transfer belt drive roller 61, intermediate transfer belt driven roller 62, intermediate transfer belt tensioning mechanism 63 and intermediate transfer rollers 64 (64*a*, 64*b*, 64*c*, and 64*d*) and is circulatively driven in the direction of arrow B in FIG. 1.

Intermediate transfer belt 60 is arranged in abutment with each photoreceptor drum 3. The color images formed on photoreceptor drums 3 are successively transferred in layers to intermediate transfer belt 60 to form a color toner image (multi-color toner image) on intermediate transfer belt 60. This intermediate transfer belt 60 is a belt-like part formed of an endless film of about 100 to 150 μm thick. Intermediate transfer belt 60 is essentially formed of polyimide, polycarbonate, thermoplastic elastomer alloy or the like.

The toner image formed on photoreceptor drum 3 is transferred to the intermediate transfer belt by means of intermediate transfer roller 64. Intermediate transfer roller 64 is rotatably supported at an intermediate transfer roller fitting portion (not shown) in intermediate transfer belt tensioning mechanism 63 of intermediate transfer belt unit 6. Applied to intermediate transfer roller 64 is a transfer bias for transferring the toner image from photoreceptor drum 3 to intermediate transfer belt 60.

A high-voltage transfer bias (high voltage of a polarity (+) opposite to the polarity (−) of the electrostatic charge on the toner) is applied to intermediate transfer roller 64 in order to transfer the toner image. Intermediate transfer roller 64 is a roller made up of a base shaft of metal (e.g., stainless steel) having a diameter of 8 to 10 mm and a conductive elastic material such as Ethylene Propylene Diene Methylene Linkage (EPDM), foamed urethane, etc., coated on the shaft surface. Use of this conductive elastic material enables uniform application of high voltage to intermediate transfer belt 60. Though in the present embodiment, roller-shaped elements are used as the transfer electrodes, brushes or other items can also be used in place.

The thus visualized toner images from respective colors of electrostatic latent images on photoreceptor drums 3 are laminated on intermediate transfer belt 60 into an image corresponding to the input image data. The lamination of toner images is conveyed by rotation of intermediate transfer belt 60 to the position where transfer roller 8 is laid out. Transfer roller 8 is applied with a voltage (high voltage of a polarity (+) opposite to the polarity (−) of the static charge on the toner) for transferring the toner image to the recording medium (paper). Further, intermediate transfer belt 60 and transfer roller 8 are pressed against each other under a predetermined nip pressure. In order for transfer roller 8 to have the nip pressure constantly, either transfer roller 8 or intermediate transfer belt drive roller 61 is formed of a hard material (metal or the like) while the other is formed of a soft material (elastic rubber roller or foamed resin roller).

The toner adhering to intermediate transfer belt 60 as a result of contact with photoreceptor drums 3 or the toner which remains on intermediate transfer belt 60 without having been transferred to the paper by transfer roller 8, would cause contamination of colors at the next operation, hence is removed and collected by intermediate transfer belt cleaning unit 65. Intermediate transfer belt cleaning unit 65 includes a cleaning blade (not shown) as a cleaning member that abuts intermediate transfer belt 60. Intermediate transfer belt 60 is supported from its interior side by intermediate transfer belt driven roller 62, at the area where this cleaning blade abuts intermediate transfer belt 60.

Paper feed tray 14 is a tray to stack recording mediums (paper) to be used for image forming and is disposed under exposure unit 1. Paper output tray 13 disposed at the top of image forming apparatus 100 is a tray to stack printed paper facedown.

Image forming apparatus 100 also includes approximately vertically arranged paper conveyance path S for guiding the paper from paper feed tray 14 to paper output tray 13 by way of transfer roller 8 and fixing unit 9. Arranged near paper conveyance path S from paper feed tray 14 to paper output tray 13 are pickup rollers 11 (11*a*, 11*b*), registration roller 7, transfer roller 8, a heat roller 9*a* and pressing roller 9*b* of fixing unit 9, and feed rollers 12 (12*a* to 12*h*).

Feed rollers 12 are a plurality of small-diametric rollers arranged along paper conveyance path S to promote and assist conveyance of recording mediums (paper). Pickup roller 11*a* is a roller disposed at the end of paper feed tray 14 for picking up and supplying the paper one sheet at a time from paper feed tray 14 to paper conveyance path S.

Registration roller 7 is a roller that temporarily suspends the paper being conveyed on paper conveyance path S. Control unit 10 causes registration roller 7 to stop the paper that has been conveyed in paper conveyance path S at the predetermined position and rotate again at correct timing for release. That is, the registration roller delivers the paper toward the transfer portion where transfer roller 8 is disposed, at such timing that the front end of the paper meets the front end of the toner image formed on the intermediate transfer belt 60.

Fixing unit 9 includes heat roller 9*a* and pressing roller 9*b*. These heat roller 9*a* and pressing roller 9*b* rotate so as to nip the paper therebetween. Heat roller 9*a* is controlled by the control unit so as to keep a predetermined fixing temperature based on a signal from an unillustrated temperature detector. Heat roller 9*a* thermally presses the paper in cooperation with pressing roller 9*b*, and fuses, mixes and presses the multi-color toner image transferred on the paper, to thereby thermally fix the toner image onto the paper.

The paper with the multi-color toner image fixed thereon is conveyed by feed rollers 12*b* and 12*c* to the inversion paper discharge pathway of paper conveyance path S and discharged onto paper output tray 13 in an inverted position (with the multi-color toner image placed facedown).

Figure 2:
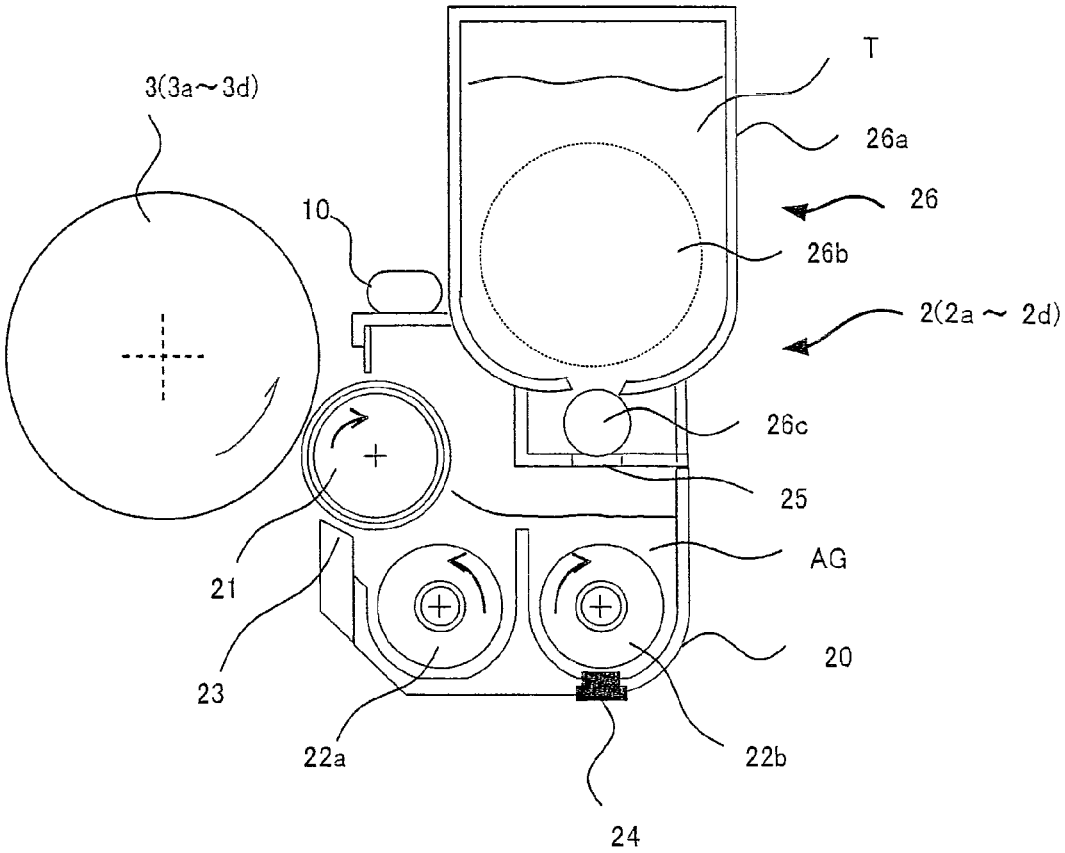
FIG. 2 is a schematic diagram showing a configuration of a developing device according to the present embodiment.

Referring next to FIG. 2, details of developing device 2 for developing an electrostatic latent image formed on photoreceptor drum 3 surface (outer peripheral side) by supplying toner to the electrostatic latent image will be described.

Developing device 2 visualizes the electrostatic latent image formed on photoreceptor drum 3 as one example of an electrostatic latent image bearer, with toner. Developing device 2 includes: a developing vessel 20 for storing a dual-component developer AG containing a toner and a carrier; a developing roller 21 arranged opposing, and close to, photoreceptor drum 3 to supply the dual-component developer AG from developer vessel 20 to the photoreceptor drum 3; a pair of conveying screws 22*a* and 22*b* for agitating and conveying the dual-component developer AG in developing vessel 20 toward developing roller 21; and a doctor blade 23 for limiting the amount of developer to be supplied to developing roller 21.

Arranged on the top of developing vessel 20 is an opening 25 that opens and closes to supply toner into developing vessel 20. A toner supply device 26 for supplying fresh toner is laid out on top of opening 25.

Figure 3:
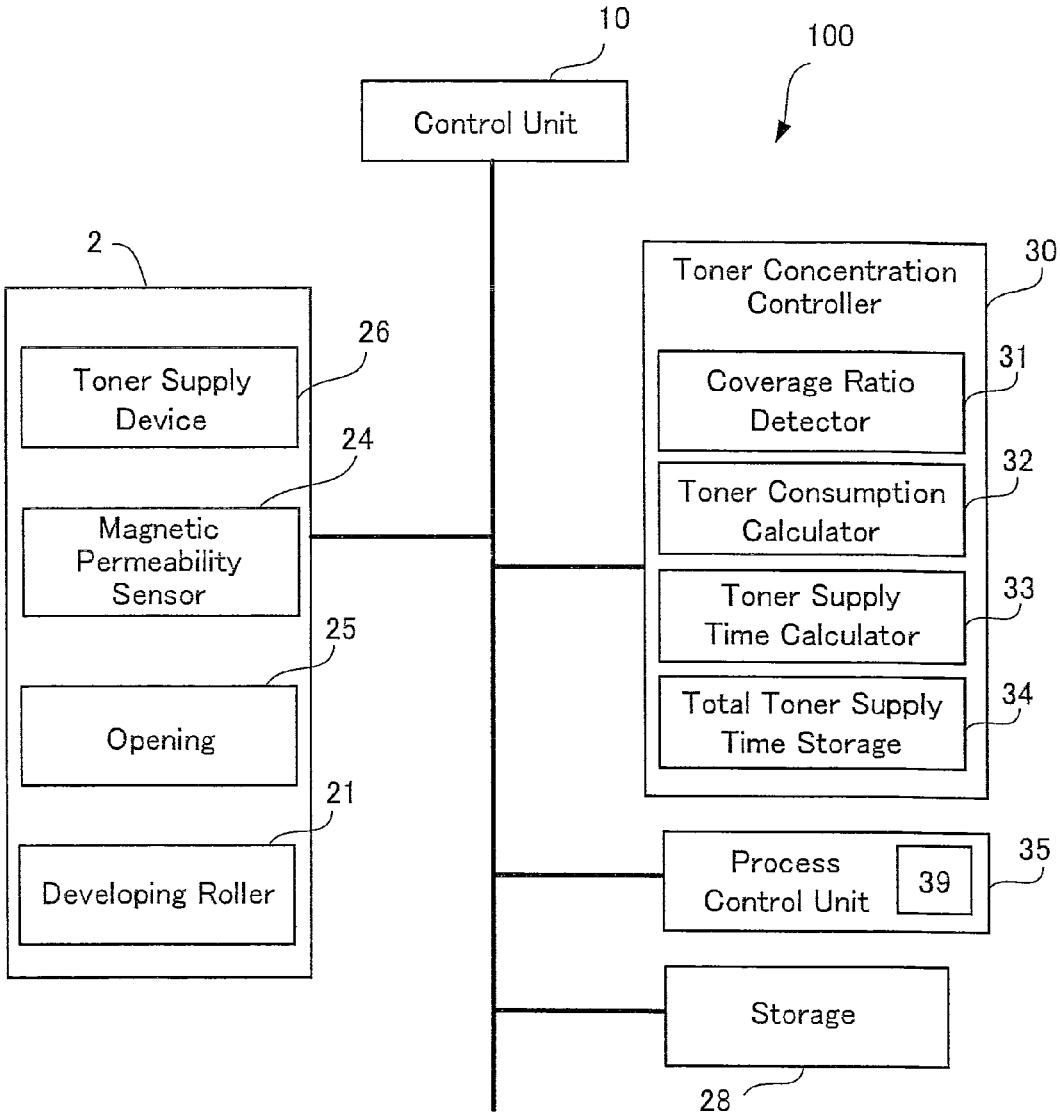
FIG. 3 is a block diagram showing a configuration of an image forming apparatus of the present embodiment.

Toner supply device 26 includes: a toner storing container 26*a* for storing toner T; a toner agitator 26*b* for agitating toner T stored in toner storing container 26*a*; and a toner supply roller 26*c* for supplying toner from toner storing container 26*a* whilst agitating. As shown in FIG. 3, toner supply device 26 supplies toner T to developing device 2 through opening 25, in accordance with a command from control unit 10.

Arranged at the bottom of developing vessel 20 under opening 25 is a magnetic permeability sensor 24. Magnetic permeability sensor 24 detects the concentration (mixture ratio) of the toner and carrier in dual-component developer AG and the residual amount of toner. When the toner concentration is high, magnetic permeability sensor 24 will detect a low voltage level because a large amount of toner adheres to the magnetic carrier so that the amount of magnetic material in the unit volume of the developer decreases. Accordingly, magnetic permeability sensor 24 compares the detected voltage level (input gain) with threshold voltage that is previously stored in a storage 28 and outputs information (output voltage level) on toner concentration. Also, the presence or absence of toner falling is detected based on the variation of the output from magnetic permeability sensor 24 when a toner supply is performed.

Figure 4:
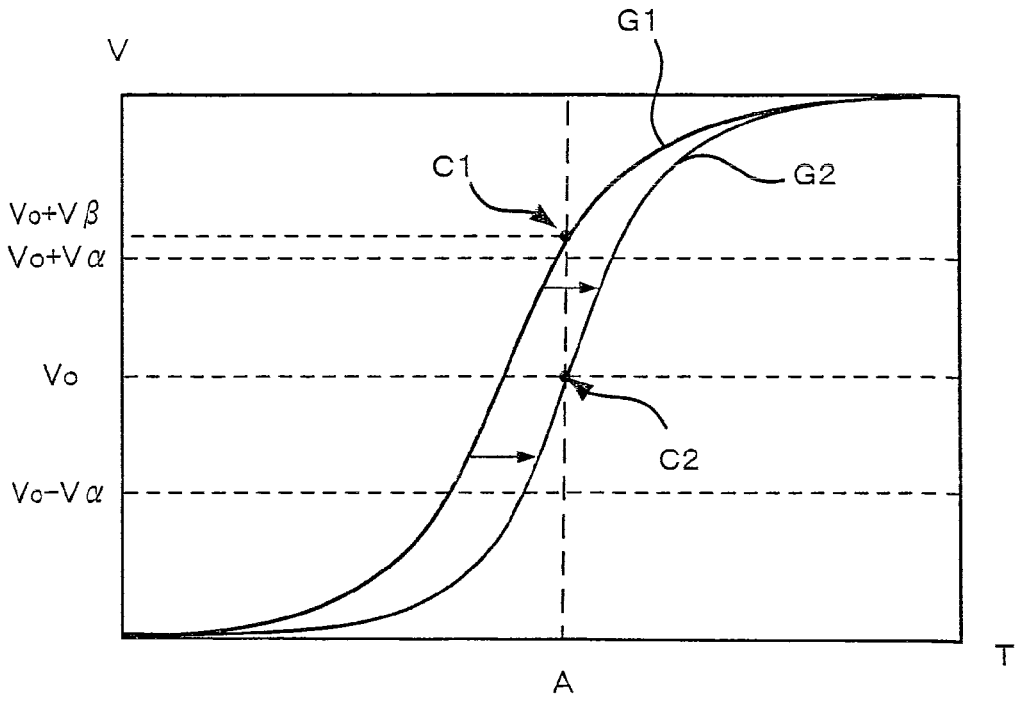
FIG. 4 is an example of a chart showing the relationships between the output voltage level of a magnetic permeability sensor and the magnetic permeability according to the present embodiment.

Now, the relationship between the output voltage level V from magnetic permeability sensor 24 and magnetic permeability T will be described. In detection of the presence or absence of toner falling by magnetic permeability sensor 24, the detection sensitivity of magnetic permeability sensor 24 becomes maximum when the output voltage level of magnetic permeability sensor 24 is located at the median (Vo) of the voltage range that can be output, as shown in FIG. 4. Here, it is assumed that the sensor gives proper sensitivity when the output voltage level falls within the range of $Vo \pm V\alpha$. Hereinbelow, Vo is called the optimal output voltage level.

Control unit 10 monitors the output voltage level of magnetic permeability sensor 24, and adjusts the input gain of magnetic permeability sensor 24 so as to keep the output voltage level falling within the range of $Vo \pm V\alpha$ when the output voltage level at the predetermined magnetic permeability falls out of the range of $Vo \pm V\alpha$.

As shown in FIG. 4, the output voltage at the magnetic permeability A falls out of the range of $Vo \pm V\alpha$ and takes a value of $Vo + V\beta$ (point C1 in FIG. 4) when the input gain of magnetic permeability sensor 24 is set at G1. Control unit 10 adjusts the input gain from G1 to G2 so as to lower the output voltage level at the magnetic permeability A to Vo (point C2) to thereby keep the detection sensitivity of magnetic permeability sensor 24 in a fair condition.

In this way, it is possible for control unit 10 to detect the presence or absence of toner falling based on the variation of the output voltage level of magnetic permeability sensor 24. Further, though the output voltage level of magnetic permeability sensor 24 changes depending on the toner concentration, the fluidity of the developer and ambient temperature and humidity, control unit 10 monitors the output voltage level of magnetic permeability sensor 24 and adjusts the input gain in accordance with the output voltage level, whereby it is possible to maintain fine detection sensitivity of magnetic permeability sensor 24, control the toner concentration into the suitable range, and perform image forming with stable toner concentration.

Next, control unit 10 according to the present embodiment will be described. FIG. 3 is a block diagram showing image forming apparatus 100 according to the present embodiment.

Image forming apparatus 100 includes control unit 10 for controlling the operation of the apparatus. Control unit 10 is made up of: for example a microcomputer; ROM (Read Only Memory) that stores control programs that show the sequential procedures to be executed by the microcomputer; RAM (Random Access Memory) that provides a work area for processing; an input circuit which receives input of signals from EEPROM (Electronically Erasable Programmable ROM)-non-volatile memory that temporarily stores calculated total toner supply time, magnetic permeability sensor 24 and unillustrated switches, and includes an input buffer and an A/D conversion circuit; an output circuit that includes drivers for driving motors, solenoids, lamps, etc.; and others. These storing means are generally called storage 28.

Control unit 10 further includes a process control unit 35 and a toner concentration controller 30, as shown in FIG. 3. Each component of control unit 10 and operation will be described hereinbelow.

In order to obtain unvaried toner concentration and image output without being affected by time-dependent variations of the photoreceptor drums and the developer, image forming apparatus 100 is operated while various processing conditions are being adjusted. This adjustment is called process control. Specific examples of the process control include adjustments to the charging potential, the amount of exposure, the correction values of toner concentration, the development bias levels, the transfer voltage level, the fixing temperature and others.

Process control unit 35 corrects control parameter values (process control settings) of developing biases in the process control. Process control unit 35 forms a toner patch (solid image) of a predetermined medium tone on photoreceptor drums 3 or intermediate transfer belt 6, and reads the amount of reflected light from the toner patch by means of a reading device including an unillustrated optical sensor to perform a halftone gamma correction process.

Specifically, in the halftone gamma correction process, the optical sensor is calibrated to set up the charging potentials, light intensity and developing biases (process control setting 39) when preparing a toner patch (solid image), whereby toner patch-forming conditions are corrected. Then, a predetermined halftone toner patch is formed on photoreceptor drum 3 or intermediate transfer belt 6. The intensity of light reflected from the toner patch is read by the optical sensor, and the optical sensor output value of the read toner patch is compared with the reference value or the target value stored in storage 28, to thereby calculate the amount of correction in the density of the printed image. Based on the calculated amount of correction, the conversion table (halftone gamma correction table) that can be used for gamma correction of brightness and color when displaying an image is corrected. With this process, it is possible to obtain constant halftone gamma characteristics, hence stabilize the printed image density. Here, the conversion table (halftone gamma correction table) has been recorded in advance in storage 28.

Next, toner concentration controller 30 of control unit 10 will be described. Toner concentration controller 30 includes, as shown in FIG. 3, a coverage ratio detector 31, a toner consumption calculator 32, a toner supply time calculator 33 and a total toner supply time storage 34.

Coverage ratio detector 31, based on information on an original image, either print density information, the printed pixel area or solid ratio (the ratio of black pixels to all the pixels in one page of original) of the input original image, calculates information on the coverage ratio of the original image, i.e., the ratio of the pixels to be printed (dots to be formed with toner) to all the pixels of the original image. That is, coverage ratio detector 31 counts dots (pixels) to determine the ratio to all the pixels in the image.

Toner consumption calculator 32 acquires the coverage ratio information on the original image from coverage ratio detector 31 and calculates a first toner consumption to be consumed by the printing operation.

Toner supply time calculator 33 acquires information on toner consumption for each original image from toner consumption calculator 32 and calculates a first toner supply time corresponding to this. At the same time, referring to the control parameter value (process control setting 39) of the developing bias, corrected in the process control by process control unit 35, a second toner consumption is calculated in accordance with the process control setting 39.

Toner supply time calculator 33 calculates a second toner supply time corresponding to the second toner consumption. As to the second toner supply time, a negative value can also be assigned. That is, if a correction to reduce the toner concentration is needed in accordance with process control setting 39, a negative value is assigned. Subsequently, the calculated results of the above first and second toner supply time are added up to determine the total toner supply time.

Total toner supply time storage 34 sums up all the toner supply time obtained every input original image from toner supply time calculator 33 and stores the total time (total toner supply time) therein. When this total time exceeds a fixed time, M seconds (M is a predetermined arbitrary figure), a toner supply request for M seconds is made to toner supply device 26, and M seconds is subtracted from the total time. Further, when the total time (total toner supply time) is calculated, toner concentration controller 30 sends a toner control request that directs toner supply for adjusting toner concentration, to control unit 10.

Then, receiving the toner control request from toner concentration controller 30, control unit 10 calculates the amount of toner to be supplied in accordance with the total toner supply time to control toner concentration.

Figure 5:
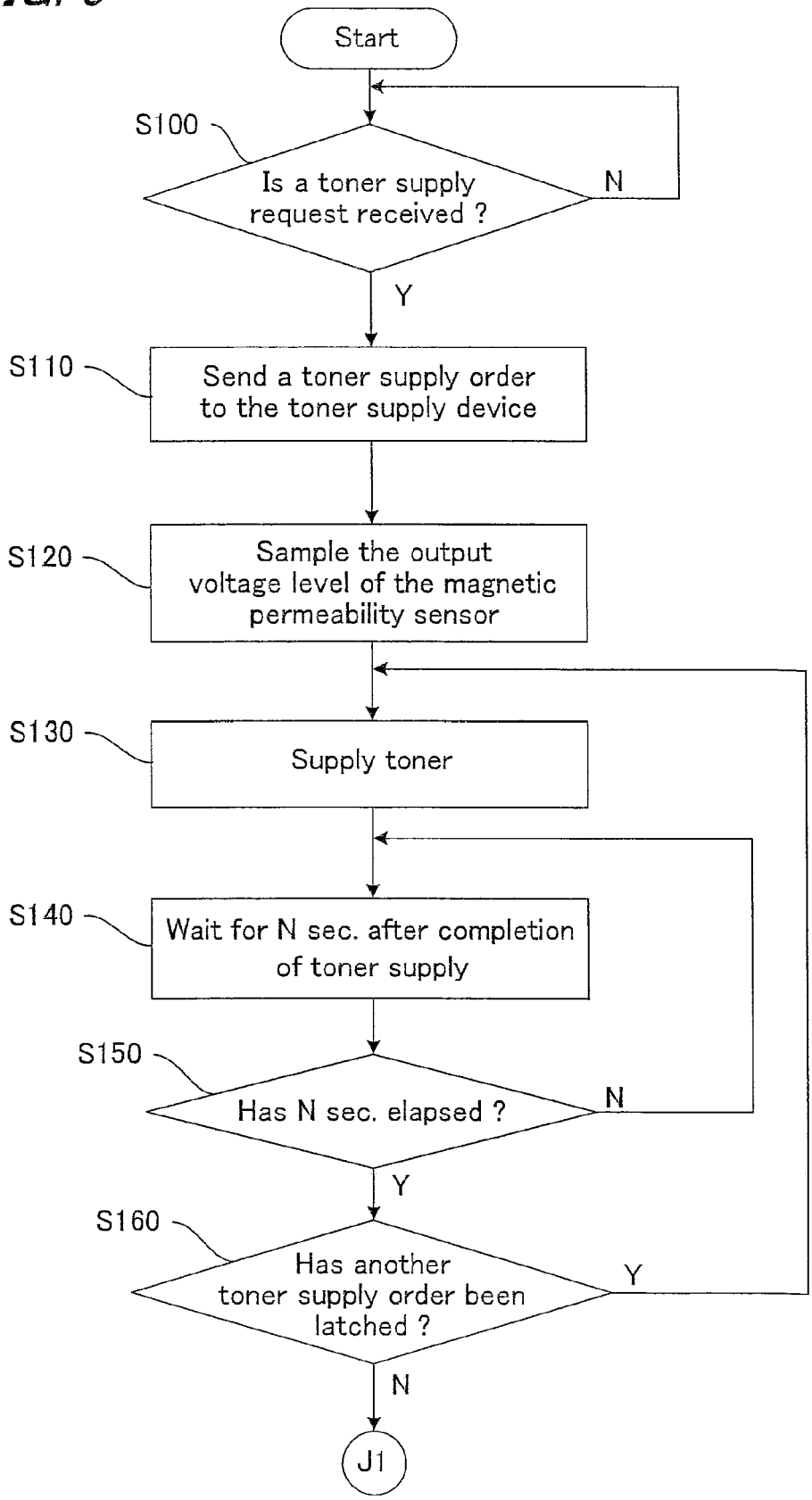
FIG. 5 is a flow chart showing the first half of a process for determining the presence or absence of toner falling by means of a magnetic permeability sensor of the present embodiment.
Figure 6:
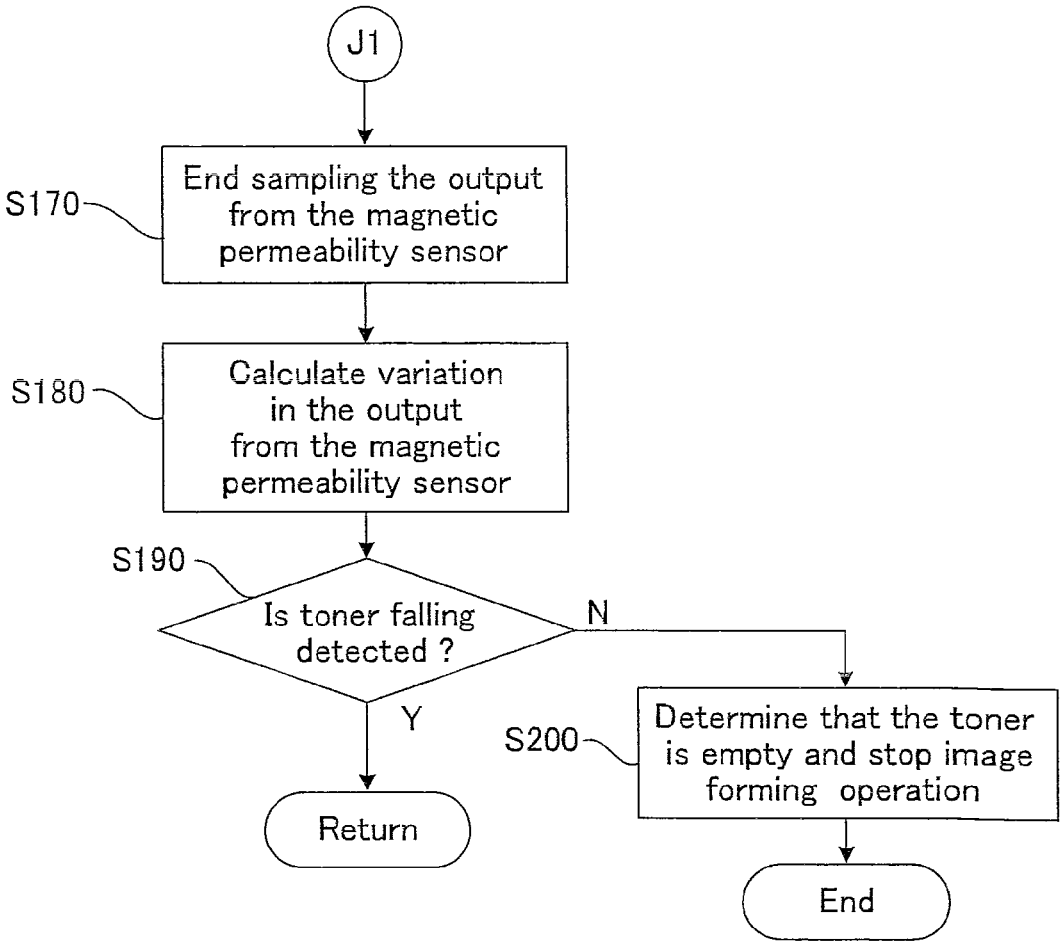
FIG. 6 is a flow chart showing the second half of a process for determining the presence or absence of toner falling by means of a magnetic permeability sensor of the present embodiment.

Next, a process of determining toner empty using magnetic permeability sensor 24 will be described. FIGS. 5 and 6 are flow charts for detecting the presence or absence of toner falling by magnetic permeability sensor 24 to determine toner empty.

When receiving a toner supply request that directs toner supply from toner concentration controller 30 (Step S100), control unit 10 sends a toner supply order to toner supply device 26 to supply a calculated amount of toner (Step S110). At the same time, sampling (detection) of the output voltage level of magnetic permeability sensor 24 is started (Step S120).

When the calculated amount of toner is supplied through opening 25 from toner supply device 26 (Step S130), toner supply device 26 enters toner supply suspended mode for a predetermined time, N seconds (N is an arbitrary figure) to prohibit an additional toner supply (Step S140). This is to secure time (N seconds) necessary for magnetic permeability sensor 24 to determine the presence or absence of toner falling. If another toner supply order is received before the lapse of the aforementioned N seconds, the order is temporarily latched (put on hold) in storage 28 to wait for a lapse of N seconds. When no toner supply order is latched (Step S160: N) after the lapse of N seconds (Step S150), the sampling of the output voltage level is ended (Step S170). When there is a toner supply order latched (Step S160: Y), another toner supply is performed following the toner supply order (Step S130).

Control unit 10 continues sampling (detection) of the output voltage level of magnetic permeability sensor 24 in the duration from the start of toner supply to the lapse of N seconds (that is, in the sampling duration of the output voltage level) to monitor the change of the output voltage level. Control unit 10 calculates the maximum and minimum output voltage levels in the sampling duration (Step S180).

Control unit 10 determines either the presence or the absence of toner falling based on the variation of the output voltage level during the sampling duration (Step S190). If it is determined that there is no toner falling (Step S190: N), the toner supply device is determined to be empty of toner and the operation of image forming is stopped (Step S200). When it is determined that there is toner falling (Step S190: Y), the control returns to the start, and the toner supply operation is repeated following a toner supply order from control unit 10.

If toner falling has been actually detected, the magnetic permeability of the developer significantly changes during the sampling duration. Accordingly, the variation of the output voltage level of magnetic permeability sensor 24 becomes large. In contrast, when no toner falling has been detected, the magnetic permeability of the developer little changes, so that the variation of the output voltage level of magnetic permeability sensor 24 is small. In this way, it is possible for control unit 10 to determine the presence or absence of toner falling (occurrence of toner empty) based on the variation of the output voltage level of magnetic permeability sensor 24.

Next, how control unit 10 adjusts the input gain of magnetic permeability sensor 24 will be described.

Figure 7:
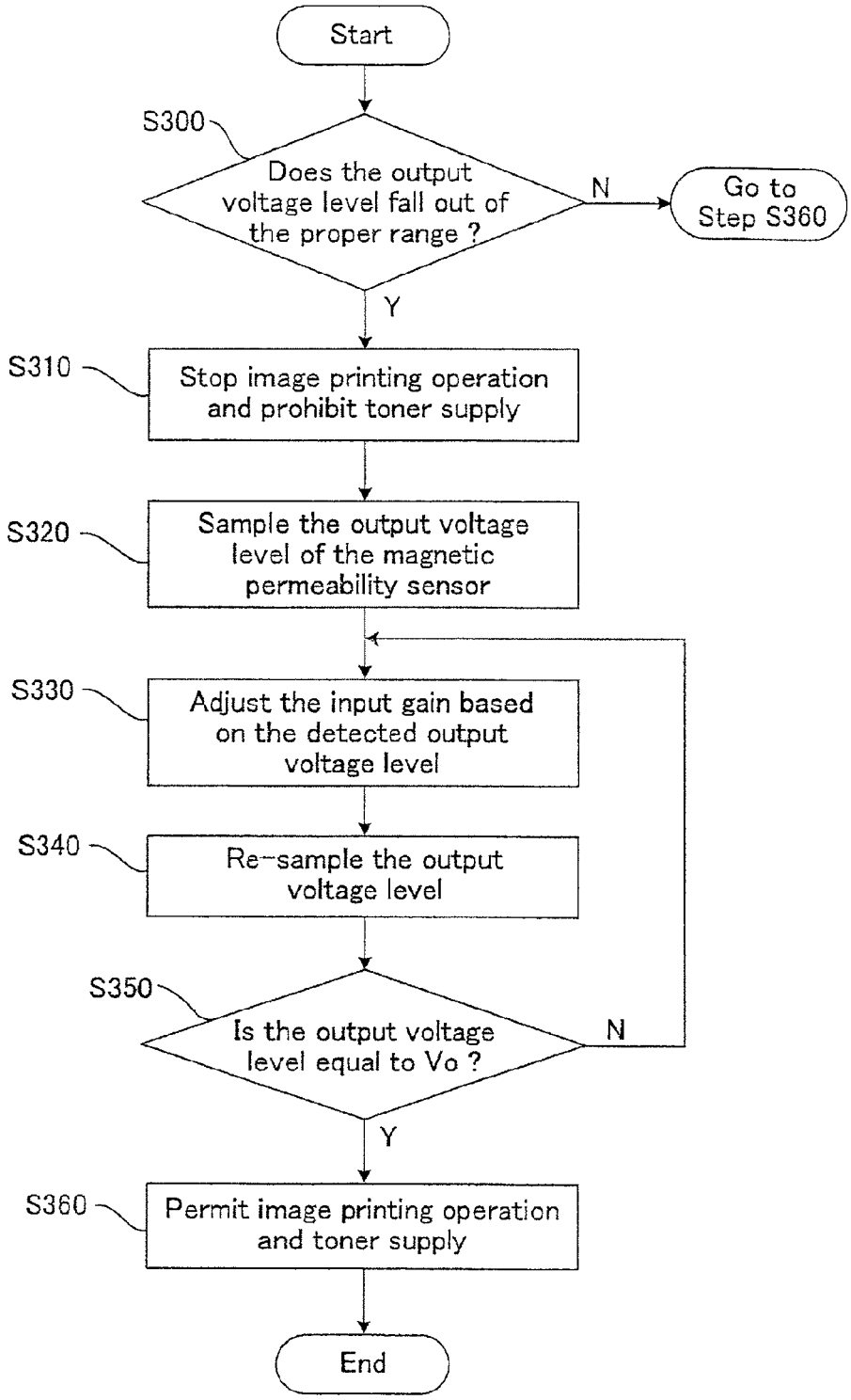
FIG. 7 is a flow chart showing a process of performing input gain control of a magnetic permeability sensor according to the present embodiment.

As described above, in order to keep the detection sensitivity of magnetic permeability sensor 24 fine, control unit 10 monitors the output voltage level of magnetic permeability sensor 24 and adjusts the input gain in accordance with the output voltage level. FIG. 7 is a flow chart showing a process of input gain control of magnetic permeability sensor 24 by control unit 10.

When the output voltage level of magnetic permeability sensor 24 falls out of the proper range (Step S300: Y), control unit 10 stops the image printing operation and prohibits toner supply (Step S310). On the other hand, if the output voltage level of magnetic permeability sensor 24 does not fall out of the proper range (Step S300: N), the control goes to Step S360 so as to permit the image printing operation and toner supply.

Then, control unit 10 samples the output voltage level of magnetic permeability sensor 24 (Step S320) and adjusts the input gain of magnetic permeability sensor 24 based on the detected output voltage level (Step S330).

After the adjustment of the input gain of magnetic permeability sensor 24, the output voltage level for the adjusted input gain is sampled again (Step S340). Control unit 10 compares the re-detected output voltage level with the optimal output voltage level Vo. If it is equal to the optimal output voltage level Vo (Step S350: Y), the start of image forming operation and toner supply is permitted (Step S360).

In comparison of the re-detected output voltage level with the optimal output voltage level Vo, if it is not equal to the optimal output voltage level Vo (Step S350: N), the adjustment of the input gain of magnetic permeability sensor 24 is repeated until the output voltage level becomes equal to the optimal output voltage level Vo.

Also, in the present embodiment, the practice of the adjustment of the input gain is not limited to only the case when the output voltage level of magnetic permeability sensor 24 falls out of the proper range of Vo±Vα, but adjustment of the input gain of magnetic permeability sensor 24 is always performed when process control is carried out without regarding the sampled value of the output voltage level.

Since the input gain of magnetic permeability sensor 24 is adjusted every time process control is performed, the output voltage level of magnetic permeability sensor 24 is periodically adjusted to the optimal output voltage level Vo. As a result, departure of the output voltage level of magnetic permeability sensor 24 from the proper range of Vo±Vα during the operation of image printing occurs less frequently so that it is possible to prevent lowering of image forming efficiency Next, how to detect a fault of image forming apparatus 100 and how to control change of toner concentration depending on the individuality of each image forming apparatus will be described.

Generally, with regard to image forming apparatuses, change of toner concentration is not uniform, but the change in toner concentration attributed to consumption of toner and the amount of toner falling differs depending on the make of the machine and depending on the individuality of each machine. It is also possible that the actual toner concentration gradually comes off the calculated value and deviates from the proper range due to individual difference between image forming apparatuses. There is also a risk of an image forming apparatus breaking down as a result of deviation of toner concentration from the proper range.

In order to restrain toner concentration from deviating from the proper range due to individuality of each image forming apparatus, the amount of toner consumption and the amount of toner falling, attributed to the individuality of each apparatus, are periodically fed back to toner concentration controller 30 of control unit 10 so as to make the toner concentration fall within the proper range.

Further, if the deviation of toner concentration has become worse to reach a stage in which it is difficult to make the toner concentration fall within the proper range, control unit 10 stops the operation of image printing and displays a repair recommendation message on an unillustrated control display.

Figure 8:
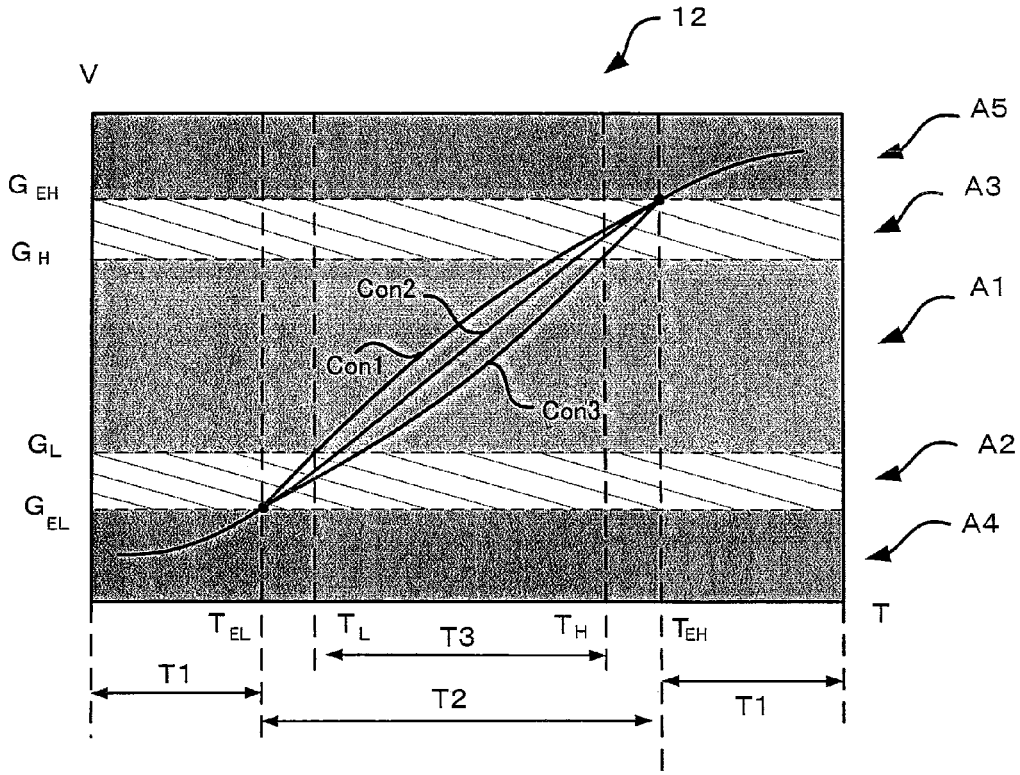
FIG. 8 is an example of a chart showing the relationships between the input gain of a magnetic permeability sensor and the toner concentration of the developer according to the present embodiment.

Referring now to FIG. 8, description will be made on the relationship between the input gain of magnetic permeability sensor 24 and the thresholds (thresholds for to controlling toner concentration) as the criteria when toner concentration controller 30 of control unit 10 determines toner concentration attributed to the amount of toner consumption and the amount of toner falling.

FIG. 8 is a chart showing the relationships between input gain V of magnetic permeability sensor 24 and toner concentration T of the developer. As shown in FIG. 8, the input gain of magnetic permeability sensor 24 is given as an input gain curve (Con2) when an image forming operation is performed to a recording medium (paper) in the image forming apparatus according to the present embodiment under a normal ambient condition with a temperature of 25 deg. C. and a humidity of 50%.

As shown in FIG. 8, toner concentration is classified into three categories. Toner concentration T1 is defined as a region that is less than a toner conventional value $T_{EL}$ and a region that is equal to or greater than $T_{EH}$, in which printed image degradation, carrier transfer to photoreceptor drum 3 and other problems are observed. Toner concentration T2 is defined as a region that is equal to or greater than toner conventional value $T_{EL}$ and less than $T_{EH}$, in which proper toner concentration is obtained. Toner concentration T3 is defined as a region that is equal to or greater than toner conventional value $T_L$ and less than $T_H$, in which proper toner concentration is obtained and presents ideal toner concentration, allowing a margin for variation in toner concentration.

The input gain and output voltage level of magnetic permeability sensor 24 are also affected by physical properties such as the fluidity of the developer and the operating environment including temperature and humidity, other than toner concentration. Therefore, the input gain adjusted by the above-described toner concentration controller 30 is also affected by these factors.

When the input gain of magnetic permeability sensor 24 was measured by changing the above experimental ambient temperature and humidity, the input gain curve (Con1) was obtained as the upper boundary of the input gain of magnetic permeability sensor 24, and the input gain curve (Con3) was obtained as the lower boundary.

The thresholds (the thresholds to control toner concentration) for the input gain of magnetic permeability sensor 24 as the criteria when toner concentration controller 30 determines toner concentration attributed to the amount of toner consumption and the amount of toner falling, are given as input gain values $G_L$, $G_{EL}$, $G_H$ and $G_{EH}$, as shown in FIG. 8.

Input gain value $G_L$ is given as a value on the input gain curve (Con1) corresponding to the lower limit value $T_L$ of the ideal toner concentration. Input gain value $G_H$ is given as a value on the input gain curve (Con3) corresponding to the upper limit value $T_H$ of the ideal toner concentration. The range from input gain value $G_L$ to input gain value $G_H$ is named area A1.

Input gain value $G_{EL}$ is given as a value on the input gain curve (Con2) corresponding to the lower limit value $T_{EL}$ of the proper toner concentration. Input gain value $G_{EH}$ is given as a value on the input gain curve (Con3) corresponding to the upper limit value $T_{EH}$ of the proper toner concentration. The range from input gain value $G_{EL}$ to less than input gain value $G_L$ and the range from input gain value $G_H$ to less than input gain value $G_{EH}$ are named areas A2 and A3, respectively. The range less than input gain value $G_{EL}$ is named area A4 and the range greater than input gain value $G_{EH}$ is named area A5. Though five areas are created in the above way, area classification may be done by setting further detailed conditions.

Within area A1, toner concentration controller 30 of control unit 10 permits image printing operation without performing any feedback control. In areas A2 and A3, the control unit permits image printing operation by adjusting toner concentration using feedback control. In areas A4 and A5, the control unit prohibits image printing operation and stops the operation of image printing.

In the feedback control by toner concentration controller 30, if a negative value is set in calculation of the first and second toner supply time under the condition of area A2, or if a positive value is set in calculation of the first and second toner supply time under the condition of area A3, total toner supply time storage 34 may regard the calculated toner supply time as being invalid and prohibit the toner supply time from being stored.

Further, in the feedback control by toner concentration controller 30, it is also possible to adjust toner concentration by multiplying a predetermined correction coefficient depending on the input gain area when calculating the first and second toner supply time. A supply coefficient 67 for each input gain area of the magnetic permeability sensor of the present embodiment is experimentally defined for each area 66, as shown in FIG. 9.

Next, offsetting of the first and second thresholds based on operating environment correction, developer life correction and coverage ratio correction will be described.

Figure 10:
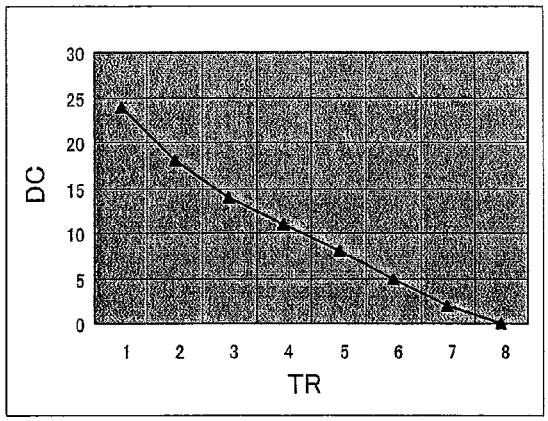
FIG. 10 is a chart showing the relationship of an operating environment correction value relative to an operation temperature and humidity environmental ratio according to the present embodiment.

As shown in FIG. 10, the operating environment correction value DC is a correction value to be added to shift the toner concentration level based on variation in operating environment such temperature, humidity and the like of the image forming apparatus. For example, the operating environment ratio TR indicates a correction value to maintain proper development performance, by decreasing the toner concentration in a high-temperature and high-humidity environment to secure the amount of electrostatic charge on toner because the static charge on toner lowers in such an environment, and by increasing the toner concentration in a low-temperature and low-humidity environment to suppress the amount of electrostatic charge on toner because the static charge on toner increases in such an environment.

Figure 11:
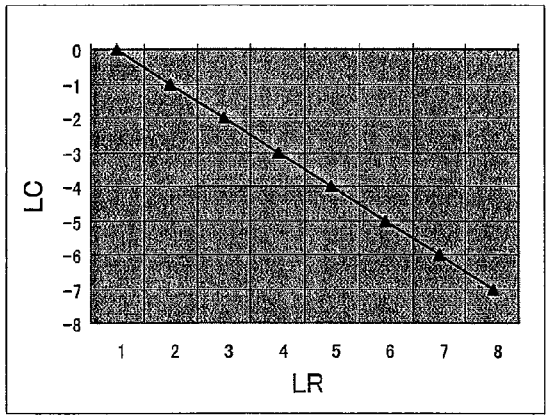
FIG. 11 is a chart showing the relationship of a developer life correction value relative to a developer life ratio according to the present embodiment.

As shown in FIG. 11, the developer life correction value LC is a correction value that is calculated based on variation due to aging of the developer. There is a tendency that the amount of electrostatic charge on toner of the developer lowers as the developer life ratio LR increases.

Figure 12:
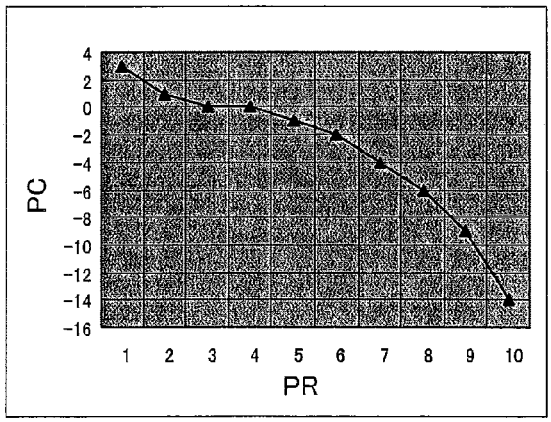
FIG. 12 is a chart showing the relationship of a coverage ratio correction value relative to a coverage ratio according to the present embodiment.

As shown in FIG. 12, the coverage ratio correction value PC is a correction value that is calculated based on variation depending on PR, the coverage ratio for each page of the input original images.

In the above embodiment, two input gain values ($G_L$, $G_H$) and two input gain values ($G_{EL}$, $G_{EH}$) are taken as the first and second thresholds to be the criteria for determining whether the input gain of the toner sensor falls within the predetermined range. Then, the first and second thresholds are flexibly set up by taking into account the variation in operating environment temperature and humidity, the developer life and the coverage ratio.

The two input gain values ($G_L$, $G_H$) as the criteria for determining whether toner supply is made by performing feedback control in accordance with the input gain from the toner sensor, and the two input gain values ($G_{EL}$, $G_{EH}$) as the criteria for determining whether the image forming apparatus is in a breakdown condition so as to prohibit the image forming operation, are determined as the thresholds that have been given consideration on the above variational factors, by taking the offset values depending on one, or the sum, of the developer life correction value depending on aging of the developer, the operating environment correction value depending on variation in operating environment and the coverage ratio correction value depending on variation in coverage ratio.

The specific example will be shown hereinbelow. Though in FIG. 8, the first threshold (the first lower threshold) is given as input gain value $G_L$, the first threshold (the first lower threshold) may be given as the sum of the input gain value $G_L$, the operating environment correction value, the developer life correction value and the coverage ratio correction value. Similarly, the first threshold (the first upper threshold) may be given as the sum of the input gain value $G_H$, the operating environment correction value, the developer life correction value and the coverage ratio correction value though in FIG. 8 the first threshold (the first upper threshold) is given as input gain value $G_H$. Further, the second threshold (the second lower threshold) may be given as the sum of the input gain value $G_{EL}$, the operating environment correction value, the developer life correction value and the coverage ratio correction value though in FIG. 8 the second threshold (the second lower threshold) is given as input gain value $G_{EL}$. Moreover, the second threshold (the second upper threshold) may be given as the sum of the input gain value $G_{EH}$, the operating environment correction value, the developer life correction value and the coverage ratio correction value though in FIG. 8 the second threshold (the second upper threshold) is given as input gain value $G_{EH}$. The above case is exemplified by designating the new thresholds by setting off the original thresholds using three variational factors as the correction values, but any one or two of them may be used to be added.

In this way, since the first and second thresholds are set in a flexible manner by taking offset values by adding to the original thresholds, one or the sum, of the developer life correction value depending on aging of the developer, the operating environment correction value depending on variation in operating environment and the coverage ratio correction value depending on variation in coverage ratio, it is possible to perform toner supply control in conformity with the variations in developer life, operating environment and coverage ratio.

Further, since toner concentration controller 30 performs feedback control so that the input gain of magnetic permeability sensor 24 will shift and fall within area A1, it is possible to perform control so as to deal with change in toner concentration attributed to the individuality of each machine, change in toner concentration due to variation of the input gain depending on the fluidity and other physical properties of the developer and the temperature, humidity and other factors of the operating environment. Further, when the toner concentration has reached to an uncontrollable level and the input gain of magnetic permeability sensor 24 falls in area A4 or A5, control unit 10 is able to positively detect occurrence of malfunction of the image forming apparatus. Moreover, when the toner concentration falls out of the proper range, it is possible to identify what has caused the trouble, either a controllable reason attributed to the individuality of each image forming apparatus or an uncontrollable reason attributed to breakdown of the image forming apparatus.

What is claimed is:

1. An image forming apparatus comprising:

a toner container storing a toner;

a developing unit performing development using a dual-component developer containing the toner and a carrier;

a toner supply unit supplying the toner from the toner container to the developing unit;

a toner sensor detecting a presence or absence of the toner falling and supplied into the developing unit; and a control unit controlling an operation of image forming, the control unit including a toner concentration controller that controls so that a toner concentration of the dual-component developer will fall within a predetermined range, wherein when detecting that an input gain of the toner sensor falls out of the predetermined range, the toner concentration controller adjusts the input gain of the toner sensor so as to fall within the predetermined range and then control a supplied amount of the toner, and the predetermined range for the input gain of the toner sensor includes a pair of first thresholds as criteria for determining whether supply of the toner should be made by performing feedback control in accordance with the input gain of the toner sensor, and a pair of second thresholds as the criteria for determining whether the image forming apparatus is in a breakdown condition so that the image forming operation should be prohibited.

2. The image forming apparatus according to claim 1, wherein the control unit includes:

a calculator calculating an amount of consumption of the toner in accordance with a coverage of the image; and, a process control unit performing process control as an image correcting process when images are formed, and, the toner concentration controller controls the amount of toner supply, based on a developing bias level when calculation of the amount of toner consumption and the process control are carried out.

3. The image forming apparatus according to claim 2, wherein the process control unit performs process control by detecting a density of a standard toner image formed on a surface of electrostatic latent image bearer and applying a developing bias in accordance with the detected density.

4. An image forming method for use in an image forming apparatus including: a toner container storing a toner; a developing unit performing development using a dual-component developer containing the toner and a carrier; a toner supply unit supplying the toner from the toner container to the developing unit; a toner sensor detecting a presence or absence of the toner falling and supplied into the developing unit; and a control unit controlling an operation of image forming, the image forming method comprising:

a toner concentration control step of performing control such that a toner concentration of the dual-component developer will fall within a predetermined range; and, a toner supply control step in which when an input gain of the toner sensor falls out of the predetermined range, the input gain of the toner sensor is adjusted so as to fall within the predetermined range and thereby control a supplied amount of the toner, the predetermined range for the input gain of the toner sensor includes a pair of first thresholds as criteria for determining whether supply of the toner should be made by performing feedback control in accordance with the input gain of the toner sensor, and a pair of second thresholds as the criteria for determining whether the image forming apparatus is in a breakdown condition so that the image forming operation should be prohibited.

5. The image forming method according to claim 4, wherein the toner supply control step of controlling the amount of toner supply includes a step of performing control in conformity with the first threshold and the second threshold.

6. The image forming method according to claim 5, wherein the two first thresholds and the two second thresholds are corrected into offset values by adding one or the sum of, a correction value depending on a developer life, a correction value depending on variation in environment and a correction value depending on a coverage ratio.

* * * * *